United States Patent [19]

White et al.

[11] Patent Number: 4,812,069

[45] Date of Patent: Mar. 14, 1989

[54] WRITING IMPLEMENT HAVING BUILT-IN PAPER DISPENSER

[76] Inventors: Kevin R. White, 1941 "C" Ave., NE., Cedar Rapids, Iowa 52402; Danny R. Gilmore, 440 Humboldt, Denver, Colo. 80218

[21] Appl. No.: 24,596

[22] Filed: Mar. 11, 1987

[51] Int. Cl.[4] ..... B43K 29/12

[52] U.S. Cl. ..... 401/195; 401/217; 242/55.53; 206/38; 206/39.8; 206/233; 400/613

[58] Field of Search ..... 401/195, 217; 242/55.53, 55.3; 312/37, 38; 206/38, 39.8, 233, 407–409, 414; 400/613, 613.1, 613.3

[56] References Cited

U.S. PATENT DOCUMENTS

| | | | |
|---|---|---|---|
| 1,069,746 | 8/1913 | Watts | 401/195 X |
| 2,957,636 | 10/1960 | Lesavoy | 242/55.53 |
| 3,010,338 | 11/1961 | Layton | 312/38 X |
| 3,033,339 | 5/1962 | Simms | 400/613 |
| 3,827,544 | 8/1974 | Smith | 400/613 |
| 3,963,358 | 6/1976 | Houser | 401/195 |
| 4,030,842 | 6/1977 | White et al. | 401/195 |
| 4,089,481 | 5/1978 | Ciuci | 242/55.53 |
| 4,108,390 | 8/1978 | Hayes | 242/55.53 |
| 4,406,421 | 9/1983 | Schultz et al. | 242/55.53 |
| 4,565,463 | 1/1986 | Otaguro et al. | 401/217 |

FOREIGN PATENT DOCUMENTS

| | | | |
|---|---|---|---|
| 0057554 | of 1982 | European Pat. Off. | 401/195 |
| 71203 | of 1915 | Switzerland | 401/195 |

*Primary Examiner*—Richard J. Apley
*Assistant Examiner*—David J. Bender
*Attorney, Agent, or Firm*—Foley & Lardner

[57] ABSTRACT

A writing implement such as a ballpoint pen combines a mechanism for selectively advancing and retracting a writing tip with a built-in roll of paper which can be dispensed and torn off. The paper roll can be mounted in a disposable cartridge which lessens the curl of the paper, facilitates removal and replacement of the paper roll, and aligns the free end of the paper with the corresponding slot in the barrel of the writing implement so that the free end of the paper need not be threaded through a narrow slot by hand.

19 Claims, 3 Drawing Sheets

WRITING IMPLEMENT HAVING BUILT-IN PAPER DISPENSER

FIELD OF THE INVENTION

This invention relates to writing implements having a built-in supply of a writing material, particularly a pen having a removable cartridge which dispenses the free end of a roll of paper.

BACKGROUND OF THE INVENTION

A number of early patents propose providing a writing implement such as a pen or pencil with a cylindrical internal chamber containing a roll of paper. The barrel of the writing implement has an access slot for feeding out the free end of the roll of paper. The paper could be withdrawn as needed by manually pulling it through the slot, and the paper supply could be replaced by disassembling the pen or pencil. See, for example, Donning U.S. Pat. No. 640,543 issued Jan. 2, 1900, Ross U.S. Pat. No. 2,073,719 issued Mar. 16, 1937, and Rieu, Jr. U.S. Pat. No. 2,076,035 issued Apr. 6, 1937. Such writing implements were generally end-loaded, but Boust U.S. Pat. No. 2,224,470 issued Dec. 10, 1940 illustrates that side-loading structures are also known. Some of these early designs included a rotatable spindle on which the paper roll was mounted, while in others, the paper roll was simply confined within a tubular chamber without any spindle.

In order to prevent the free end of the paper roll from being accidentally withdrawn back through the slot into the pen barrel, various means such as rachet mechanisms were provided to ensure that the paper roll could not rotate in a reverse direction. See, e.g., Moore U.S. Pat. No. 2,512,168 issued June 20, 1950 and Moore U.S. Pat. No. 1,266,299 issued May 14, 1918. It is also known to employ a tension block for holding the paper roll in position. See, for example, Calvento U.S. Pat. No. 1,431,722 issued Oct. 10, 1922. More advanced designs provided means for extending and retracting the free end of the paper roll from the slot by, for example, rotating part of the pen cap. See, for example, Moore U.S. Pat. No. 1,359,725 issued Nov. 23, 1920, and Ritzert U.S. Pat. No. 2,005,110 issued June 18, 1935. Feeding mechanisms of this general type have included friction roller type dispensers actuated by a pair of meshing gears. Josephs U.S. Pat. No. 2,287,618 issued June 23, 1942, illustrates one such design for a nonwriting implement.

Other early devices approached the problem of providing a writing implement with a built-in paper supply somewhat differently. In some devices the paper or writing material was provided in the form of individual pieces or sheets, see, e.g. Gray U.S. Pat. No. 2,081,036 issued May 18, 1937, and Bruck et al. U.S. Pat. No. 2,301,364 issued Nov. 10, 1942. Another design provided a paper roll as an attachment to a writing implement such as a pencil. See, for example, Sinclair U.S. Pat. No. 1,322,966 issued Nov. 25, 1919.

More recently attention has turned to providing multifunction writing instruments having a multiplicity of useful functions, i.e. containing a knife, paper clip, ruler, and writing instrument all built into the same device. See, for example, Chao U.S. Pat. No. 4,602,397 issued July 29, 1986, Parry U.S. Pat. No. 3,961,852 issued June 8, 1975, Schuh U.S. Pat. No. 3,378,195 issued Apr. 16, 1968 and Waterbury U.S. Pat. No. 3,175,685 issued Mar. 30, 1965. Little recent effort has been directed to improving the operation or convenience of the older paper dispensing writing implements.

Such known paper dispensing writing implements lacked a convenient means for replacing the paper supply. Generally, replacing the paper roll involved cumbersome steps of positioning a loose paper roll within the tubular paper chamber and threading the free end through a narrow slot by hand, possibly including the additional step of feeding the free end of the paper through a friction roller mechanism as well. The early designs also fail to provide a paper-dispensing manual writing implement which combines the advantages of a paper dispenser with the well-known spring action, retractable tip ballpoint pens. The latter are currently in wide use, and provide a mechanism for alternately advancing and retracting a writing tip in response to pressing a button generally located at the cap end of the pen. Patents exemplifying such pens include the patents to Weisser, Johnson and Malm cited below. These pens may be placed in a pocket with the writing tip in retracted position without fear of ink from the tip marking the fabric.

The present invention concerns a more convenient paper dispensing writing implement containing a roll of paper which is dispensed as needed from within the barrel of the writing implement.

SUMMARY OF THE INVENTION

The present invention provides a writing implement, such as a pen, with a built-in roll of a writing material, such as paper, which may be fed out as needed. According to one aspect of the invention, the roll of writing material is part of a removable cartridge which includes a generally cylindrical casing, a roll of writing material retained in the casing, and a guide for directing a free end of the roll from the cartridge at a selected position. The cartridge facilitates feeding the free end of the paper roll from a slot in the barrel of the writing implement. Usually the user of the implement need not thread the writing material through the slot manually.

According to a further aspect of the invention, the functions of a spring action pen having a retractable tip are combined with the advantages of pen having a built-in roll of paper.

BRIEF DESCRIPTION OF THE DRAWING

The invention will be further described with reference to the accompanying drawing, wherein like numerals denote like elements, and.

DETAILED DESCRIPTION OF PREFERRED EXEMPLARY EMBODIMENT

Figures 1, 2, 3, 5, 7, 8, 9:
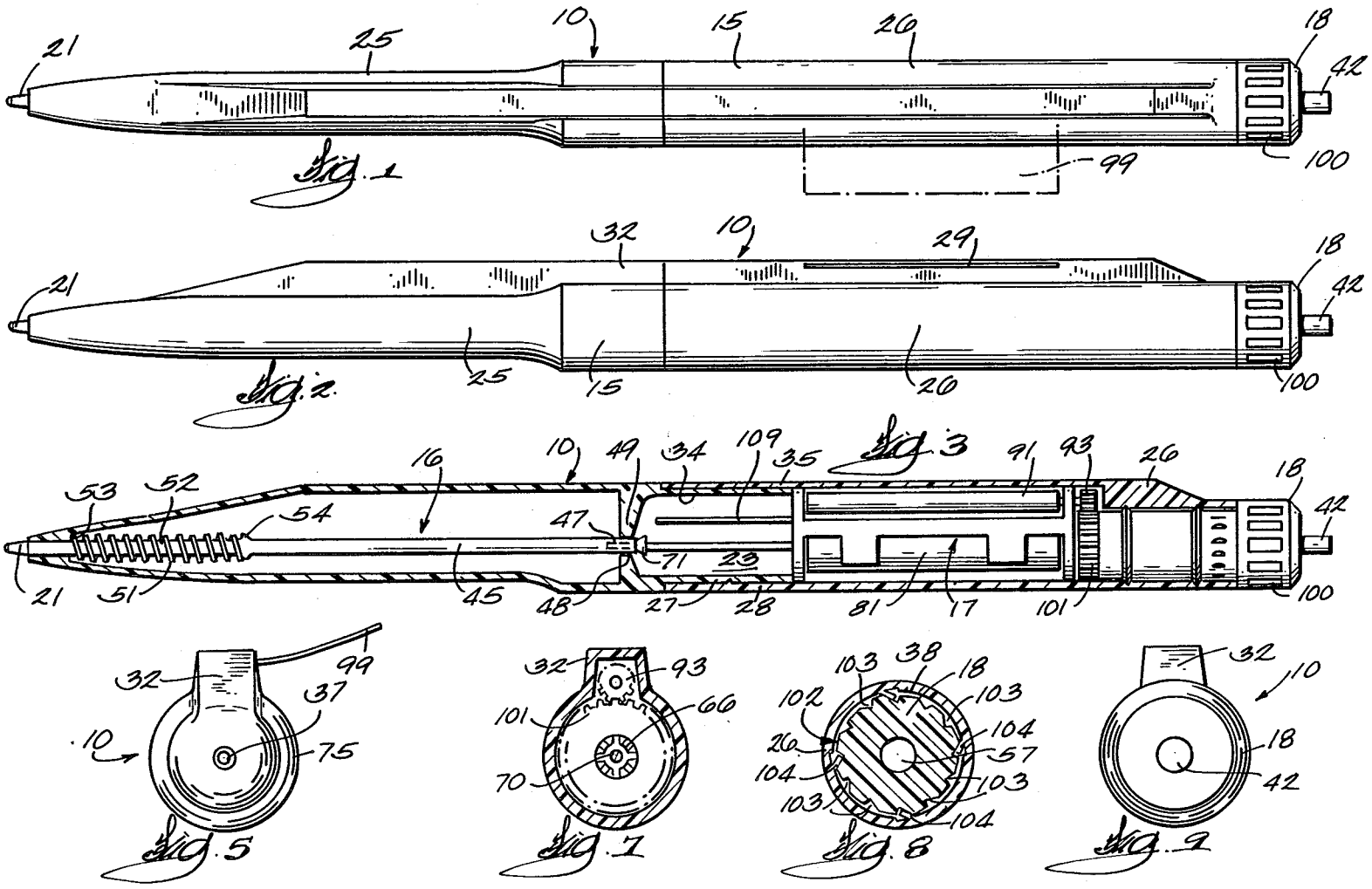
FIG. 1 is a top plan view of a writing implement according to the present invention.
FIG. 2 is a side elevational view of the writing implement shown in FIG. 1.
FIG. 3 is the same view as FIG. 2, with the barrel of the writing implement partly broken away.
FIG. 5 is a front-end view of the writing implement shown in FIG. 1.
FIG. 7 is a cross-sectional view taken along the line 7—7 in FIG. 4.
FIG. 8 is a cross-sectional view taken along the line 8—8 in FIG. 4.
FIG. 9 is a rear view of the writing implement shown in FIG. 1.
Figure 10:
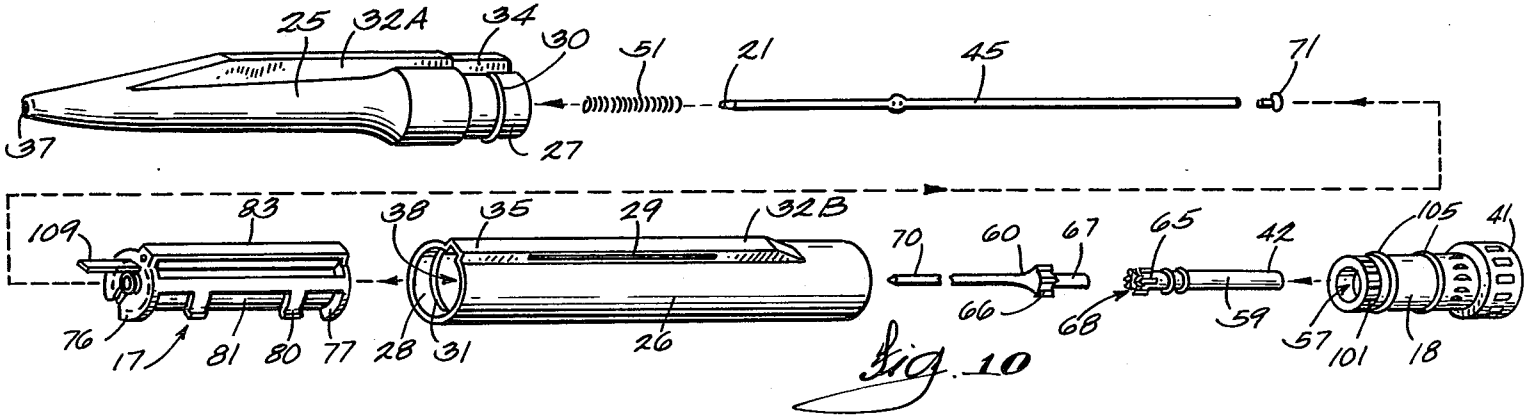
FIG. 10 is an exploded view of the writing implement shown in FIGS. 1–9.

FIGS. 1 through 10 illustrate a writing implement (pen) 10 according to the invention capable of dispensing a piece of paper therefrom. Pen 10 generally includes an elongated hollow plastic barrel 15, a means for making visible markings on a writing surface, such as a ballpoint pen mechanism 16, a cartridge 17 having means for dispensing a writing material (e.g. paper), means including a knob 18 for feeding the writing material from the cartridge 17 in cooperation with corresponding means on cartridge 17, and a mechanism (means) 19, e.g. a reciprocating indexing device, for alternating projecting and retracting the writing tip 21 of the pen mechanism 16. Each of these basic components is described in detail hereafter.

As illustrated in FIGS. 1 through 3, barrel 15 comprises a pair of hollow front and rear barrel sections 25 and 26, respectively, which fit together at a central portion of pen 10 by respective coupled tubular ends 27, 28 to provide a means for accessing (opening) barrel 15 to permit removal and replacement of cartridge 17 and ballpoint pen mechanism 16. Tubular end 27 has a partial, annular rib 30 which mates with a corresponding partial, annular groove 31 in tubular end 28 to provide a detent means for removably snap-fitting barrel sections 25, 26 together.

Barrel sections 25, 26 together define an internal chamber 23 and a hollow lengthwise fin 32 of generally rectangular shape in cross-section which preferably extends most of the length of pen 10. Front barrel section 25 includes a corresponding front section 32A of fin 32, and rear barrel 26 includes a corresponding rear portion 32B of fin 32. Rear fin portion 32B has a dispensing slot 29 disposed in a generally radially extending side wall thereof. Slot 29 is elongated in the lengthwise direction of pen 10. Tubular ends 27, 28 include mating radially outwardly projecting portions 34, 35, respectively, which mate in the same manner as tubular ends 27, 28. Front barrel section 25 further has a small round tip opening 37 at the front thereof.

Rear barrel section 26 has a lengthwise, generally cylindrical bore 38 open at opposite ends thereof. Knob 18 is inserted into a round rear opening 39 in bore 38. An enlarged diameter gripping portion 41 of knob 18 abuts against rear opening 39 and is coaxial with barrel 15. Similarly, as illustrated in FIG. 9, a button 42 projects from the end of knob 18 and is used to actuate tip projecting and retracting mechanism 19, as described hereafter.

As illustrated in FIG. 3, ballpoint pen mechanism 16 housed within front barrel section 25 includes an ink-filled pen tube 45 ending in ballpoint writing tip 21. A rear end portion 47 of ink tube 45 extends through a close-fitting opening 48 in an annular wall 49 within front barrel section 25. Annular wall 49 keeps pen tube 45 in position. Pen tube 45 further has a spring 51 mounted on a front end portion 52 thereof which spring 51 is resiliently biased between a front end wall 53 on the interior of barrel section 25 and a stop 54 disposed on the outer surface of ink tube 45. Spring 51 urges ink tube 45 and writing tip 21 rearwardly from the tip-projected position shown in FIG. 3.

Figures 11, 12, 13, 14:
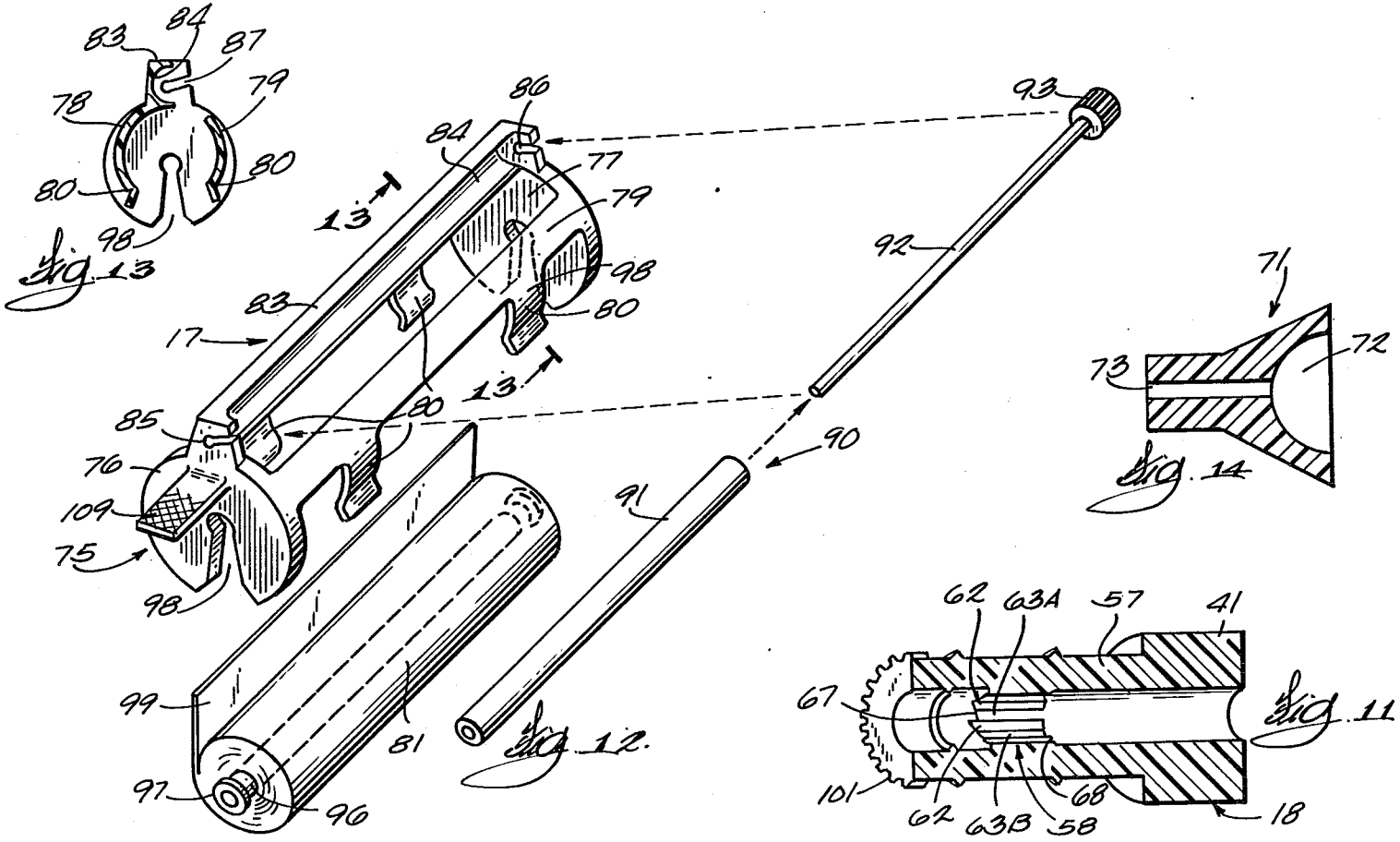
FIG. 11 is a cutaway, side view of the knob shown partly broken away in FIG. 4.
FIG. 12 is an exploded view of a paper roll cartridge according to the invention as shown in FIGS. 3, 4 and 10.
FIG. 13 is a cross-sectional view of the casing of the cartridge shown in FIG. 12, taken along the line 13—13 in FIG. 12.
FIG. 14 is a cross-sectional view of an ink tube cap according to the invention as shown in FIGS. 3 and 10.

As illustrated in FIGS. 3, 4, 10 and 11, retracting/-projecting mechanism 19 cooperates with pen mechanism 16 to alternately project and retract writing tip 21 in response to successive pressing of button 42. Retracting/projecting mechanism 19 is disposed in part within a lengthwise bore 57 within knob 18. As shown in FIG. 11, bore 57 has a series of conventional cam track grooves 58 which cooperate with a pushbutton spur gear element 59 and a rotating, writing tip-positioning element 60. Reciprocating indexing mechanisms of this general type are wellknown, as illustrated by the following U.S. patents: Weisser U.S. Pat. No. 3,137,276 issued June 16, 1964, Weisser U.S. Pat. No. 3,196,838 issued July 27, 1965, Johnson U.S. Pat. No. 3,120,837 issued Feb. 11, 1964 and Malm U.S. Pat. No. 3,183,892 issued May 18, 1965, the entire contents of which patents are hereby incorporated herein by reference. For purposes of the present invention, grooves 58 and pushbutton element 59 are essentially identical to structures described in the prior art. However, rotating element 60 is advantageously modified to accommodate paper cartridge 17, as described in detail below.

As shown in FIG. 11, cam track grooves 58 comprise a series of alternating longitudinal ribs 62 and grooves 63. Grooves 63 include alternate shallow grooves 63A and deep grooves 63B. The front ends of ribs 62 and shallow groove 63A are angled as shown. Radially extending teeth 65 on pushbutton element 59 slidingly engage each of grooves 63A, 63B. Push-button element 59 and rotating element 60 have meshing end profiles, e.g., mating zigzag end faces as shown. Radially enlarged lugs 66 on a rear end portion of rotating element 60 move alternately between stop positions defined by shallow grooves 63A and deep grooves 63B to define the projected and retracted writing tip positions, respectively. The number of lugs 66 is half the number of teeth 65. Enlarged lugs 66 cannot enter shallow grooves 63A due to their large size, and thus abut against the front end face 67 thereof. The action of teeth 65 in grooves 63 in cooperation with the force of spring 51 forces lugs 66 to move along the associated angled surfaces and enter deep grooves 63B to rear end faces 68 thereof, thereby assuming a retracted position. This is but one type of reciprocating indexing device which might be employed in the writing implement of the present invention.

Rotating positioning element 60 has a cylindrical end portion 67 which mates with a corresponding recess 68 in pushbutton element 59. Retaining element 60 further has an elongated actuating extension rod (pin) 70 which engages a concave end recess 72 in an end cap 71 inserted into ink tube 45. As shown in FIG. 14, end cap 71 preferably has a central air passage 73 to allow air to enter ink tube 45 so that the ink will flow smoothly. End cap 71, a part of pen mechanism 16 together with ink tube 45, spring 51, tip 21 and stop 54, allows the motion of pushbutton element 59 to be transmitted to project and retract writing tip 21. Extension rod 70 penetrates cartridge 17 along its central axis (see FIG. 4).

As shown in FIGS. 12 and 13, cartridge 17 includes a plastic casing or clip 75 of generally cylindrical shape which fits into internal chamber 23 of barrel 15, preferably into bore 38 of rear barrel section 26. Casing 75 has a pair of generally round front and rear end walls 76, 77, respectively and a pair of circumferentially curved elongated side walls 78, 79 including resiliently deformable clip arms 80 for retaining a roll of paper 81. Side wall 78 is integral with a guide projection (guide means) 83 which extends approximately radially relative to the lengthwise axis of casing 75 and has a curved inner side wall 84 and a pair of front and rear end walls 85, 86, respectively which include aligned spindle mounting grooves 87 therein. The profile of guide projection 83 in cross-section conforms to the profile of the hollow interior of fin 32. Friction roller assembly 90, including a friction roller 91 mounted for unison rotation with a spindle 92, is rotatably mounted within guiding projection 83 by suitable means, such as snapping opposite end portions of spindle 92 into spindle grooves 87. Spindle 92 has a gear element 93 disposed at its rear end which provides a means for feeding out free end 99 by selective rotation of roller 91. Spindle 92 is snapped into position so that rear wall 86 is interposed between roller 91 and gear 93. Gear 93 serves as part of the mechanism for feeding paper from cartridge 17 when cartridge 17 is installed into barrel 15.

Paper roll 81 is mounted on a hollow spindle 96 through which extension rod 70 penetrates when cartridge 17 is installed in pen 10. Spindle 96 includes suitable means, such as annular end flanges 97, so that paper roll 81 may be snapped into aligned, radially extending mounting grooves 98 in end walls 76, 77 of casing 75. Clip arms 80 snap around paper roll 81 to secure it within casing 75. Free end 99 of paper roll 81 is then placed against curved wall 84 of guiding projection 83 and roller assembly 90 is snapped into position, clamping free end 99 of roll 81 between roller 91 and curved wall 84, which are disposed in close proximity to each other and have complementary curvature. There is no need to thread end 99 of roll 81 between curved wall 84 and roller 91.

Figure 6:
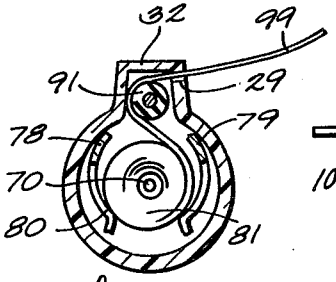
FIG. 6 is a cross-sectional view taken along the line 6—6 in FIG. 4.

Roller 91 and curved wall 84 are positioned to perform dual functions of reducing the curl of the paper by curling it in a direction opposite to the direction of winding of paper roll 81, and precisely determining the position at which free end 99 is fed from cartridge 17. As shown in FIG. 6, cartridge 17 is configured so that free end 99 of paper roll 81 will be fed through narrow slot 29 in rear fin portion 32B.

Figure 4:
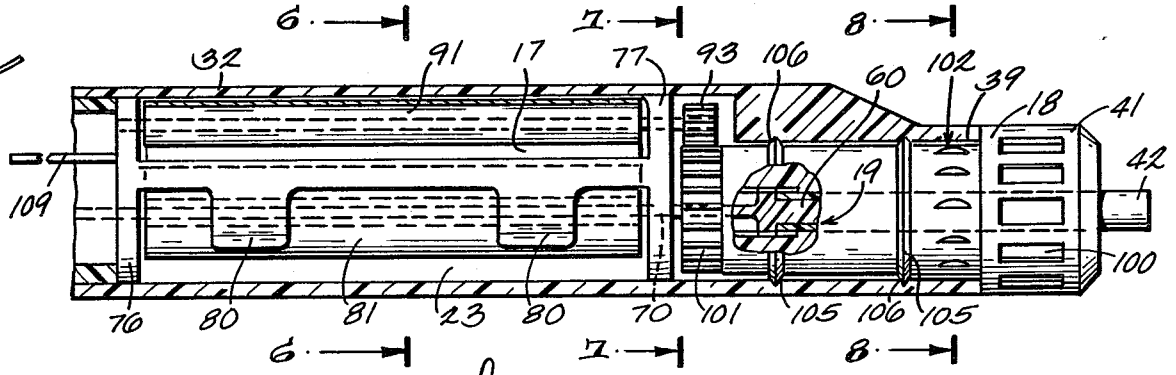
FIG. 4 is a partial, enlarged view of a rear end portion of the writing implement shown in FIG. 3, with the actuator knob partly broken away.

Knob 18 has a gear wheel portion 101 formed at its front end which meshes with gear 93 of cartridge 17 when cartridge 17 is installed in barrel 15. Enlarged gripping portion 41 of knob 18 has a circular array of gripping indentations 100 in its outer surface. Rotation of knob 18 is transmitted by gears 93, 101 to friction roller assembly 90, as illustrated in FIG. 4. Rotation of knob 18 in the appropriate direction feeds free end 99 of paper roll 81 from slot 29. If desired, suitable means can be provided for preventing rotation of knob 18 in the opposite direction, which would cause free end 99 to be retracted into slot 29. In the illustrated embodiment, such means comprises a rachet mechanism 102 including a series of circularly disposed indentations 103 in knob 18 forwardly of enlarged portion 41, which engage pawls 104 disposed on the inner periphery of bore 38. Knob 18 further has a pair of annular ribs 105 which mate with associated annular grooves 106 on the inner periphery of bore 38 so that knob 18 may be snap fitted therein. Pawls 104 are preferably sufficiently flexible to allow passage of annular ribs 105 when knob 18 is inserted into rear barrel section 26.

Operation of pen 10 according to the foregoing embodiment of the invention is as follows. To project and retract writing tip 21, the user presses button 42, the part of pushbutton element 59 which projects rearwardly from bore 57 of knob 18. In the manner of conventional spring action ballpoint pens, pressing the button alternately projects and retracts writing tip 21 due to the action of reciprocating indexing mechanism 19. Cartridge 17 does not hinder this operation because extension rod 70 movably penetrates hollow spindle 96 in a coaxial manner. When ink tube 47 needs replacing, barrel sections 25, 26 can be pulled apart to allow removal of ink tube 45 through annular wall 49. A new ink tube 45 having a corresponding spring 51 and end cap 71 is inserted through opening 48, and the barrel sections 25, 26 are reassembled so that extension rod 70 engages recess 72 of end cap 71.

If cartridge 17 requires replacement, barrel sections 25, 26 are again pulled apart, and cartridge 17 is withdrawn in a lengthwise direction from the forward end of bore 26. For this purpose, a lengthwise (upright) removal tab or projection 109 can be provided on the outer surface of rear end wall 76 of casing 75 to facilitate grasping and removal of cartridge 17. Since casing 75 and related parts of the expended cartridge 17 can be made of inexpensive materials such as plastic and rubber, the used cartridge may be discarded. A new cartridge 17 is then inserted into bore 38 of barrel section 26, until gear 93 is in appropriate position to mesh with gear 101 on knob 18. At the same time, cartridge 17 must be inserted so that extension rod 70 properly penetrates spindle 96. Barrel sections 25, 26 may then be reassembled, and the paper end 99 fed through slot 29 by rotating knob 18. It should not generally be necessary to manually assist feeding of the free end 99 of paper roll 81 through slot 29, and of course it is also unnecessary to thread free end 99 between friction roller 91 and the correspondingly curved surface 84 of guiding projection 83.

Free end 99 of paper roll 81 is fed out by means of knob 18 until a satisfactorily large piece of paper is obtained. The desired piece of paper is then torn off from slot 29, for which purpose an overhanging or sharpened edge (not shown) can be provided. Rachet mechanism 102 prevents free end 99 from being withdrawn back through slot 29. When additional paper is desired, knob 18 is operated again to feed more paper from roll 81.

It will be understood that the above description is of a preferred exemplary embodiment of the invention, and that the invention is not limited to the specific forms shown. For example, a variety of writing tip projecting and retracting mechanisms are known in the art, and any may be substituted for the particular reciprocating indexing device shown in the illustrated embodiment. Friction roller 91 may, for example, comprise a series of spaced-apart smaller rollers, or a series of radially extending arms which function to friction feed the free end 99 of paper roll 81 against the curved inner wall 84 of guiding projection 83. Mating tubular ends 27, 28 of barrel sections 25, 26, may, for example, be threadedly coupled to one another if fin 32 is limited in length to rear barrel section 26 only. If the tip projecting/retracting function is not desired, the associated mechanisms may be omitted, and a longer ink tube 45 may coaxially penetrate hollow spindle 96. These and other modifications may be made without departing from the scope of the invention as expressed in the appended claims.

We claim:

1. A writing implement, comprising:

an elongated, generally cylindrical, hollow barrel having a radially outwardly extending hollow fin elongated in the lengthwise direction of said barrel, said fin having a dispensing slot formed therethrough, and said barrel having an internal chamber therein which is in communication with said dispensing slot;

marking means disposed in said barrel for making visible markings on a writing surface;

a cartridge disposable within said internal chamber of said barrel, including a generally cylindrical casing, a roll of writing material, means for rotatably retaining said roll of writing material in said casing, and a guiding projection extending radially outwardly from said casing which fits into said fin and is positioned to direct a free end of said roll in writing material from said cartridge at a selected position corresponding to said dispensing slot in said fin, said guiding projection including a curved inner wall and a roller mechanism rotatably mounted in close proximity to said curved wall, said free end of said writing material roll being threaded between said curved inner wall and said roller mechanism; and access means for opening said barrel to permit removal and replacement of said cartridge.

2. The writing implement of claim 1, wherein said roller mechanism further comprises a spindle having a gear disposed at one end portion thereof, and a friction roller mounted for integral rotation with said gear and said spindle.

3. The writing implement of claim 2, further comprising a knob inserted in a rear opening of said barrel, said knob including a gripping portion disposed rearwardly of said barrel and a gear wheel portion disposed within said barrel for meshed engagement with said gear of said friction roller mechanism for transmitting rotational motion of said knob to said friction roller and feeding said free end of said writing material roll through said dispensing slot in response to rotation of said knob in a feeding direction.

4. The writing implement of claim 3, further comprising a ratchet mechanism disposed on said knob and said barrel for preventing rotation of said knob in a direction causing withdrawal of said free end of said roll through said dispensing slot.

5. The writing implement of claim 2, wherein said casing comprises a pair of generally circular front and rear end walls and a side wall uniting said end walls, said roll of writing material including a hollow spindle and a continuous sheet of writing material wrapped therearound, said end walls including means for rotatably mounting said spindle of said writing material roll between said end walls within said casing.

6. The writing implement of claim 1, wherein said radially extending guiding projection is elongated in the lengthwise direction of said casing.

7. The writing implement of claim 6, wherein said guiding projection has a pair of opposing front and rear end walls substantially coplanar with a pair of generally circular end walls of said casing, said end walls of said guiding projection further having means for rotatably mounting said spindle of said friction roller mechanism therein.

8. The writing implement of claim 1, wherein said free end of said paper roll is threaded in a generally S-shaped conformation within a said barrel, said free end being pressed against said curved wall by said roller in a direction opposite to the direction of winding of said roll.

9. A writing implement, comprising:

a barrel having an internal chamber and a dispensing slot;

marking means disposed in said barrel for making visible markings on a writing surface;

a cartridge disposable within said internal chamber of said barrel including a generally cylindrical casing having a pair of generally circular front and rear end walls and a side wall uniting said end walls, a roll of writing material including a hollow spindle and a continuous sheet of writing material wrapped therearound, means for rotatably retaining said roll of writing material in said casing, and a guiding projection extending radially outwardly from said casing positioned to direct a free end of said roll of writing material form said cartridge at a selected position corresponding to said dispensing slot in said barrel, said guiding projection including a curved inner wall and a roller mechanism rotatably mounted in close proximity to said curved wall, said free end of said writing material roll being threaded between said curved inner wall and said roller mechanism, said roller mechanism further including a spindle having a gear disposed at one end portion thereof, and a friction roller mounted for integral rotation with said gear and said spindle;

feeding means engagable with said gear for selectively dispensing a free end of said roll through said dispensing slot of said barrel;

access means for opening said barrel to permit removal and replacement of said cartridge; and a generally circumferentially directed clip arm on said side wall of said casing for retaining said writing material roll within said casing.

10. The writing implement of claim 9, wherein said casing of said cartridge includes a pair of said side walls in generally opposing positions, each of said side walls having a pair of said clip arms, said clip arms being disposed in opposing pairs in spaced-apart positions along the length of said side walls.

11. A cartridge for dispensing a writing material from a writing implement, comprising:

a generally cylindrical casing including a pair of generally circular end walls and a side wall uniting said end walls, said side wall having a circumferentially directed clip arm disposed thereon;

a roll of writing material retained within said casing by said clip arm;

means for rotatably disposing said roll of writing material between said end walls of said casing;

a radially extending guide projection disposed on said casing having a curved wall disposed to curl a free end of said writing material roll in a direction opposite a winding direction of said writing material roll;

a roller mechanism rotatably mounted in close proximity to said curved wall of said guiding projection for friction feeding a free end of said roll between said roller mechanism and said curved wall of said guiding projection; and means for effecting selective rotation of said roller mechanism to feed said free end of said writing material roll from said cartridge.

12. The cartridge of claim 11, wherein said roller mechanism comprises a friction roller mounted on a spindle for unison rotation therewith, and said guide projection further comprises a pair of opposing end walls having radial grooves in which said spindle is rotatably disposed.

13. The cartridge of claim 12, wherein said rotation effecting means comprises a gear disposed on an end portion of said spindle for unison rotation therewith.

14. A writing implement, comprising:

a barrel having an internal chamber and a dispensing slot;

marking means disposed in said barrel for making visible markings on a writing surface;

a cartridge disposable within said internal chamber of said barrel, including a generally cylindrical casing, a roll of writing material rotatably retained in said casing, and a guiding projection extending radially outwardly from said casing positioned to direct a free end of said roll of writing material from said cartridge at a selected position corresponding to said dispensing slot in said barrel, said guiding projection including a curved inner wall and a roller mechanism rotatably mounted in close proximity to said curved wall, said free end of said writing material roll being threaded between said curved inner wall and said roller mechanism, said roller mechanism including a spindle having a gear disposed at one end portion thereof, and a friction roller mounted for integral rotation with said gear and said spindle;

access means for opening said barrel to permit removal and replacement of said cartridge;

a knob inserted in a rear opening of said barrel, said knob including a gripping portion disposed rearwardly of said barrel and a gear wheel portion disposed within said barrel for meshed engagement with said gear of said friction roller mechanism for transmitting rotational motion of said knob to said friction roller and feeding said free end of said writing material roll through said dispensing slot in response to rotation of said knob in a feeding direction; and ratchet mechanism disposed on said knob and said barrel for preventing rotation of said knob in a direction causing withdrawal of said free end of said roll through said dispensing slot, said rachet mechanism including a series of indentations located on the outer periphery of said knob between said gripping portion thereof and said gear wheel portion thereof, and a series of pawls disposed on the inner periphery of said internal chamber in said barrel.

15. A writing implement, comprising:

a barrel having a tip opening and a dispensing slot;

marking means disposed in said barrel having a writing tip for making visible markings on a writing surface;

means for selectively projecting and retracting said writing tip through said tip opening between a retracted position within said barrel and a projected writing position outside of said barrel, including an actuator button for manually alternately causing projection and retraction of said writing tip, and a reciprocating indexing device operatively connected to said button for effecting alternate lengthwise movement of said marking means between a forwardmost writing tip projected position and a rearwardmost writing tip retracted position;

a cartridge disposable within said internal chamber of said barrel, including a casing having a pair of generally circular front and rear end walls and a side wall uniting said end walls, a roll of writing material rotatably retained in said casing, said roll having a hollow spindle and a continuous sheet of writing material wrapped therearound, and said end walls including means for rotatably mounting said spindle of said roll between said end walls within said casing, said guide means for directing a free end of said roll of writing material from said cartridge at a selected position corresponding to said dispensing slot in said barrel, said guide means comprising a radial guiding projection having a curved inner wall and a roller mechanism rotatably mounted in close proximity to said curved inner wall, said free end of said writing material roll being threaded between said curved inner wall and said roller mechanism, said roller mechanism including a spindle having a gear disposed at one end portion thereof, and a friction roller mounted for integral rotation with said gear and said spindle;

access means for opening said barrel to permit removal and replacement of said cartridge; and feeding means engagable with said gear of said roller mechanism for selectively dispensing a free end of said roll of writing material through said dispensing slot of said barrel, including a knob rotatably disposed in a rear opening in said barrel remote from said tip opening, said knob having a lengthwise bore extending therethrough, and said reciprocating indexing device comprises a series of cam track grooves disposed on the inner surface of said lengthwise bore in said knob, a pushbutton element having teeth disposable in said grooves, and a rotating element having radial lugs disposable in said grooves and an elongated extension rod which penetrates said roll of writing material and operatively engages said marking means to project and retract said writing tip.

16. The writing implement of claim 15, wherein said marking means comprises an ink tube disposed within said barrel, said barrel having a front end opening through which said writing tip of said ink tube is projected and retracted, and resilient means for urging said ink tube rearwardly towards said writing tip retracted position.

17. The writing implement of claim 15, wherein said knob has a gripping portion disposed rearwardly of said barrel and a gear wheel portion disposed within said barrel for meshed engagement with said gear of said roller mechanism for transmitting rotational motion of said knob to said friction roller and feeding said free end of said writing material roll through said dispensing slot in response to rotation of said knob in a feeding direction.

18. A writing implement, comprising:

an elongated, generally cylindrical, hollow barrel having a dispensing slot therein, which barrel comprises elongated, front and rear barrel sections, said front section having a writing tip opening at a front end portion thereof and a rear access opening at a rear end thereof remote form said tip opening, said rear barrel section having a front access opening and a rear opening therein, said barrel having means for removably coupling said barrel sections together to close said barrel;

marking means disposed in said front barrel section having a writing tip for making visible markings on a writing surface;

means disposed in said rear barrel section for selectively projecting and retracting said writing tip through said tip opening between a retracted position within said barrel and a projected writing position outside of said barrel, including an actuator button for manually alternately causing projection and retraction of said writing tip, a reciprocating indexing device operatively connected to said button, and an elongated actuator rod operatively connected to said indexing device for transmitting motion of said button to said writing tip;

a cartridge disposable within said barrel, including a casing having a pair of generally circular, front and rear end walls and a side wall uniting said end walls, a roll of writing material rotatably retained in said casing, said roll of writing material including a hollow spindle and a continuous sheet of writing material wrapped therearound, said end walls including means for rotatably mounting said spindle of said writing material roll between said end walls within said casing, and guide means for directing a free end of said roll of writing material from said cartridge at a selected position corresponding to said dispensing slot in said barrel, said guide means comprising a guiding projection having a curved wall and a roller mechanism rotatably mounted in close proximity to said curved wall, said free end of said writing material roll being threaded between said curved inner wall and said roller mechanism; and feeding means for selectively dispensing a free end of said roll of writing material through said dispensing slot of said barrel, wherein said marking means further comprises a tube containing an ink, said tube having said writing tip at a front end thereof and an opening at a rear end thereof, and an end cap inserted into said open end of said tube, said end cap having an air flow passage disposed to allow ventilation of said ink tube and a generally concave, rearwardly opening recess therein, said actuator rod penetrating through said cartridge and engaging said end cap at said concave recess during projection and retraction of said writing tip.

19. The writing implement of claim 18, wherein said air flow passage in said end cap communicates with said concave recess.

* * * * *